US006192963B1

(12) United States Patent
Chen

(10) Patent No.: US 6,192,963 B1
(45) Date of Patent: Feb. 27, 2001

(54) SLAT ACTUATING AND POSITIONING DEVICE FOR VENETIAN BLINDS

(76) Inventor: Dong-Rong Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/408,938

(22) Filed: Sep. 30, 1999

(51) Int. Cl.[7] ..... E06B 9/30
(52) U.S. Cl. ..... 160/168.1 R
(58) Field of Search ..... 160/168.1 R, 173 R, 160/176.1 R, 172 R, 170 R, 171 R, 236, 178.3 R

(56) References Cited

U.S. PATENT DOCUMENTS 5,060,709 * 10/1991 Simon ..... 160/168.1 R
5,573,051 * 11/1996 Judkins ..... 160/168.1 R
5,582,226 * 12/1996 Voss et al. ..... 160/168.1 R
5,664,614 * 9/1997 Debs ..... 160/168.1 R
5,769,140 * 6/1998 Tuzmen ..... 160/168.1 R
5,918,657 * 7/1999 Tuzmen ..... 160/168.1 R

* cited by examiner

*Primary Examiner*—David M. Purol
(74) *Attorney, Agent, or Firm*—A & J

(57) ABSTRACT

The present invention relates to a slat-actuating and positioning device for venetian blinds having a plurality of restriction cords provided in between two main cords to position the blind slats of the venetian blinds. A recessed positioning slot is provided on the blind slat corresponding to the main cords such that an actuating and positioning structure formed from the blinds and the main cords. A plurality of lugs are provided at intervals along the main cord for the passage of a suspension cord to the base seat below the blind slats. The structure of the present invention provides excellent stability in actuating the blind slats and improves the longevity of the venetian blinds.

1 Claim, 6 Drawing Sheets

SLAT ACTUATING AND POSITIONING DEVICE FOR VENETIAN BLINDS

BACKGROUND OF THE INVENTION a) Technical Field of the Invention

The present invention relates to a slat-actuating and positioning device for venetian blinds, and in particular, to a slat-actuating device employing a plurality sets of restriction cords for the mounting of the blind slats so as to firmly actuate (releasing or closing) the slats of the venetian blinds.

b) Description of the Prior Art

A conventional venetian blinds structure has been disclosed in ROC Utility Model Patent No. 81204926. As shown in FIGS. 6 and 7, there is a restriction cord 22 located in between two lateral main cords 21 of a pulling cord 20. The restriction cord 22 restricts the top and the bottom of the slat 30. At the center of the blind slat 30, a hole 31 is provided to allow the passage of a suspension cord 40 so as to actuate the upward and downward movement of the slat 30. In this structure, the replacement of blind slat 30 is very difficult and inconvenient With respect to mounting procedures. An improvement of this structure is shown in FIG. 7. In between two lateral main cords 21 of a pulling cord 20, a respective restriction cord 22 is provided to restrict the top and the bottom of the blind slat 30. In this structure, no hole is provided to the blind slat 30. However, the slat 30, at a position corresponding to one side of the main cord 21, is provided with a recessed positioning notch 32. At the lateral side of the slats, a plurality of holes are provided for the passage of a suspension cord 40. Thus, when the blind slats 30 and the bottom base seat 50 are actuated, the blind slats 30 and the bottom base seat 50 are lifted by force of the suspension cord 40. Thus, the blind slats 30 and the base seat 50 will be tilted and separated. As a result of the uneven force exerted in actuating the blind slats 30, the suspension cord 40 may be damaged. In addition, the combination of the blind slats 30 by pulling is separated and not in order.

SUMMARY OF THE INVENTION

It is an object of the invention to mitigate the above disadvantage. The invention more particularly aims at providing slat actuating and positioning device for venetian blinds, wherein a suspension cord together with another cord pass through a lug located at the sides of the main cord, and wind across the blind slats and the base seat. Thus, this structure provides a smooth actuating and an orderly structure for storage action. In addition, in combination with a plurality sets of restriction cords, and a plurality of positioning slots on the blind slats, the entire structure is a stable and rigid combination.

These and other aspects of the invention will be apparent from and elucidated with reference to the embodiment described hereinafter.

DETAILED DESCRIPTION OF THE PREFERRED EMBODIMENT

Figure 1:
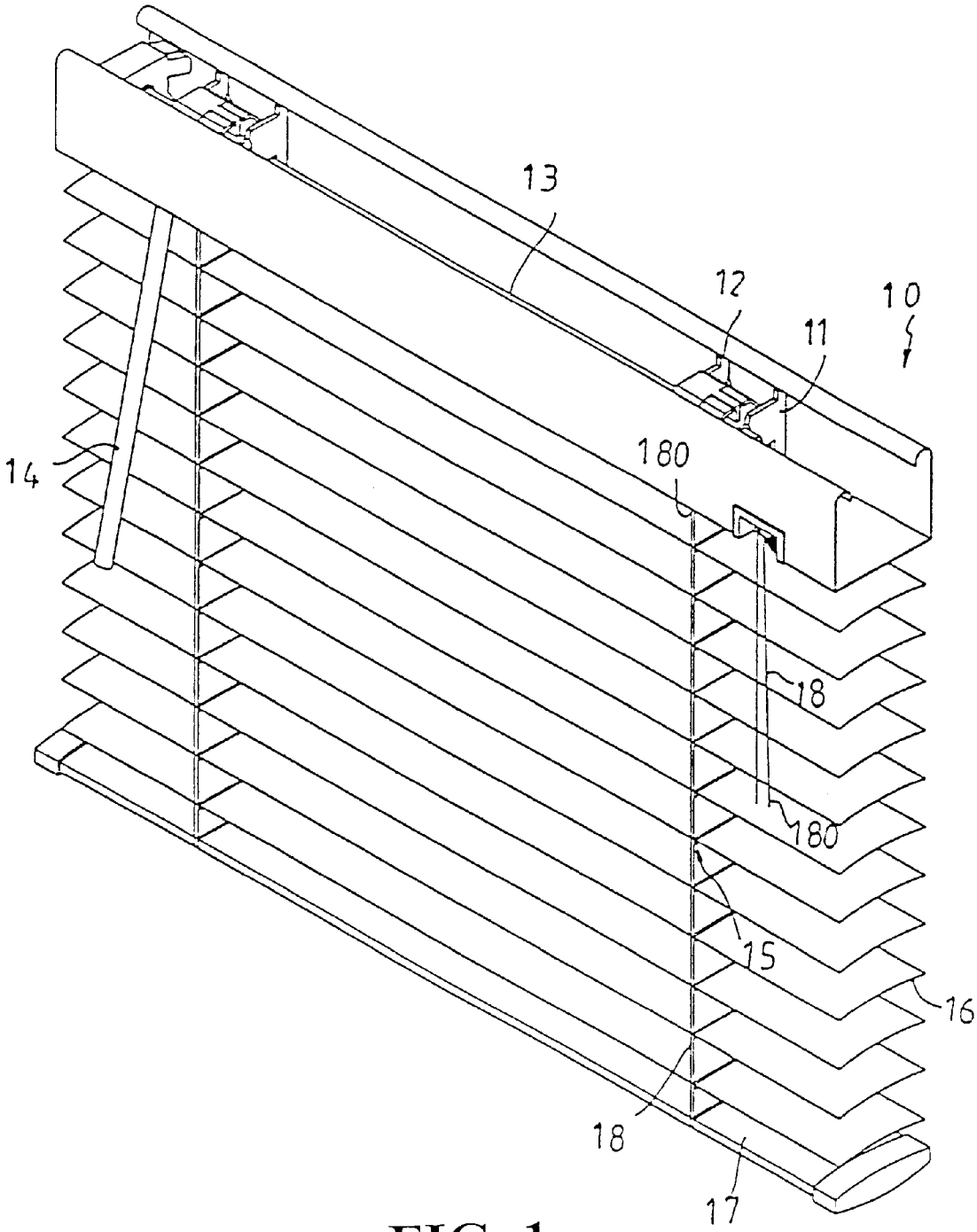
FIG. 1 is a perspective view of the venetian blind of the present invention.

Referring to FIGS. 1, 2, 3, 4 and 5, the structure of the present invention is more or less similar to that of a conventional venetian blind. In accordance with the present invention, a slat-actuating and positioning device for venetian blind comprises a frame body 10 and a fixing seat 11. A slat control element 12 is pivotally mounted at the center region of the top section of the two lateral walls of the fixing seat 11, and the slat control element 12 is driven by a control shaft 13. A pulling cord 15 is provided to the slat control element 12. A main cord 150 is located at the sides of the pulling cord 15, and a restriction cord 151 is provided in between two main cords 150. The restriction cord 151 allows the slats 16 to pass there through and the bottom section of the main cord 150 is fixed to a base seat 17. A suspension cord 18 is provided at one side of the main cord 150 for actuating the entire structure of the venetian blinds.

The present invention is characterized in that the suspension cord 18 is connected at a fixing end 180 at one side of the fixing seat 11 and surrounds the slats 16 and the base seat 17, and then passes to the frame body 10 from the fixing seat 11 to form a pulling end 181, for the pulling of the user. A plurality of lugs 152 are provided at intervals along the two main cords 150 to allow the passage of the suspension cord 18 for pulling.

In accordance with the present invention, the pulling end 181 of the suspension cord 18 passes the lugs 152 of the pulling cord 15 to fix the blind slats 16 and the base seat 17 so that the blind slats 16 are in order. In actuating, the blind slats 16 and the base seat 17 are restricted at the lateral sides thereof, and the tilting of the slats 16 is avoided. In other words, the blind slats 16 and the base seat 17 can be lifted up smoothly.

In accordance with the present invention, the restriction cord 151 is mounted in between the two main cords 150, and the restriction cord 151 is mounted in parallel in pairs, and is provided in a plurality of sets. A plurality of sets of the restriction cord 151 provides the mounting of a plurality of blind slats 16, or a plurality of blind slats 16 with various of colors for replacement so as to improve the convenience and effectiveness in application. A recessed positioning slot 160 is provided to the slats 16 corresponding to the main cords 150 such that the blind slats 16 can be exactly engaged with the main cord 150.

In accordance with the present invention, the following advantage can be obtained. For example 1) The pulling action is stable and the closing of blind slats 16 is in order. As the blind slats 16 and the base seat 17 are pulled and the lateral sides thereof are restricted by the suspension cord 18, the stability of the pulling action is improved. After the pulling cord is pulled up, the blind slats 16 and the base seat 17 are rigidly closed as a stable structure.

2) Stability of the blind slats 16. The engagement of the positioning slot 160 of the blind slats 16 with the main cord of the pulling cord 15 provides the blind slats 16 with great stability.

Figure 2:
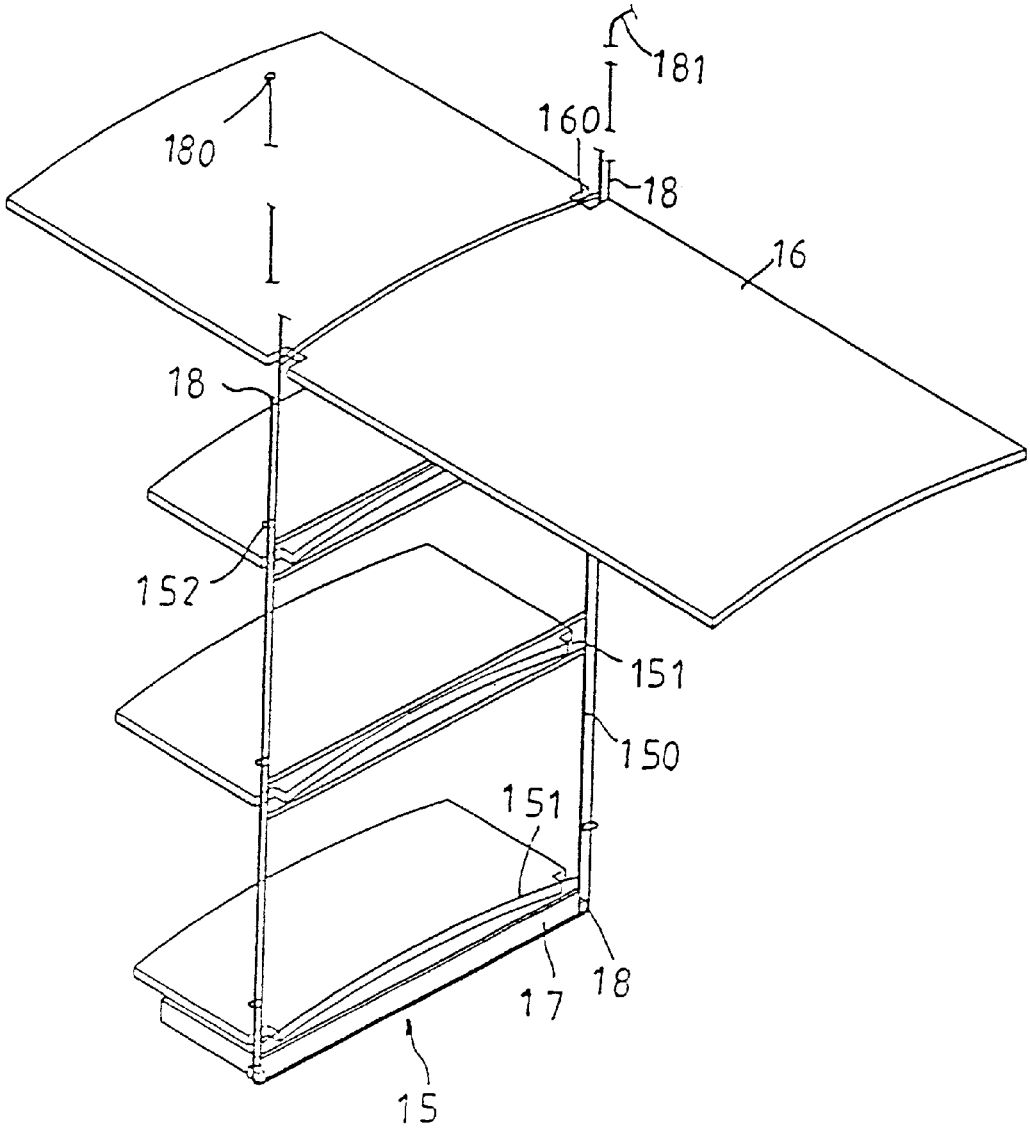
FIG. 2 is a partial enlarged view of the venetian blind of the present invention.
Figure 3:
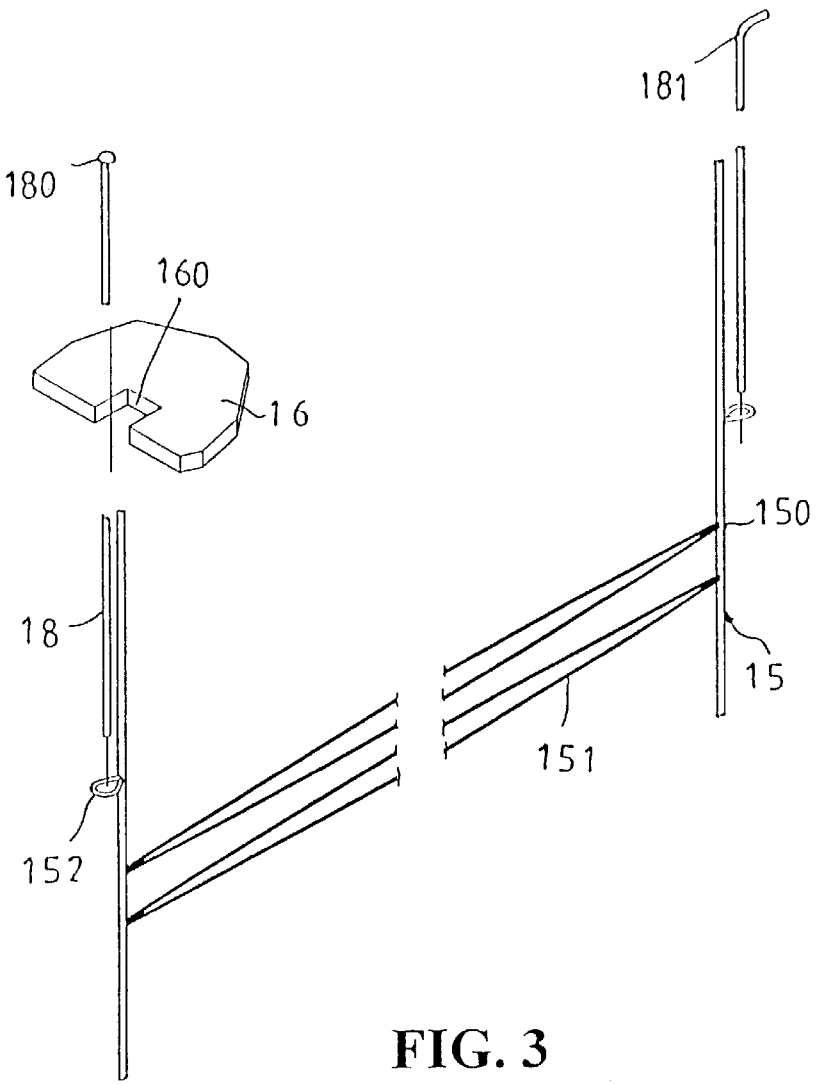
FIG. 3 is a partial enlarged view of the venetian blind of the present invention.
Figure 4:
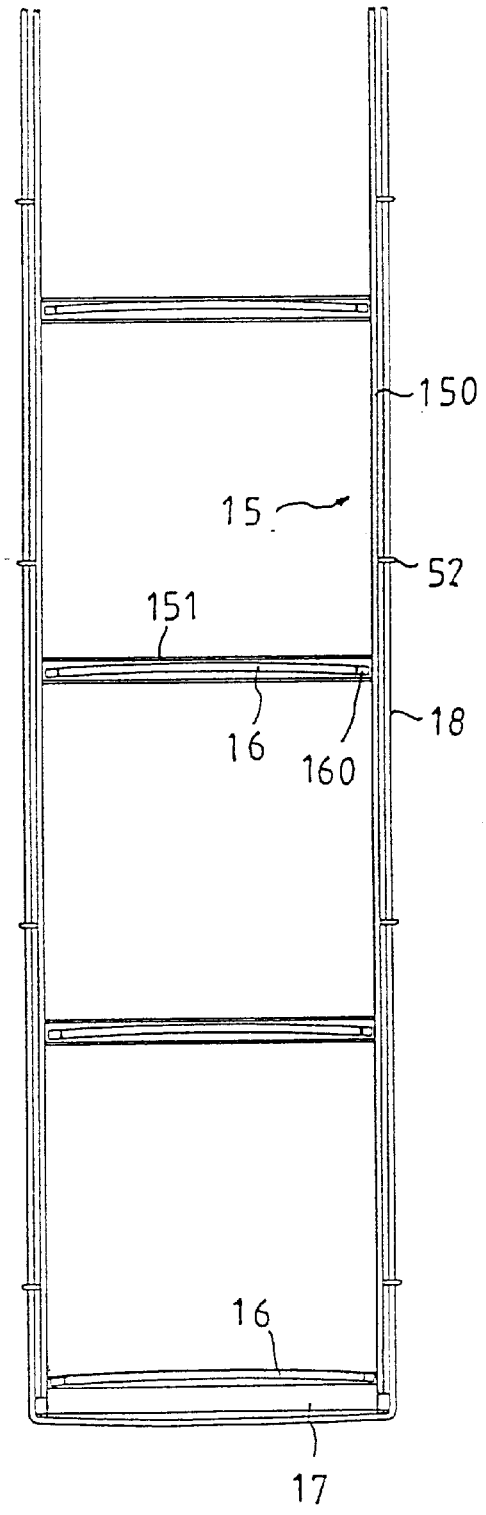
FIG. 4 is a schematic plan view of a partial enlarged venetian blind of the present invention.
Figure 5:
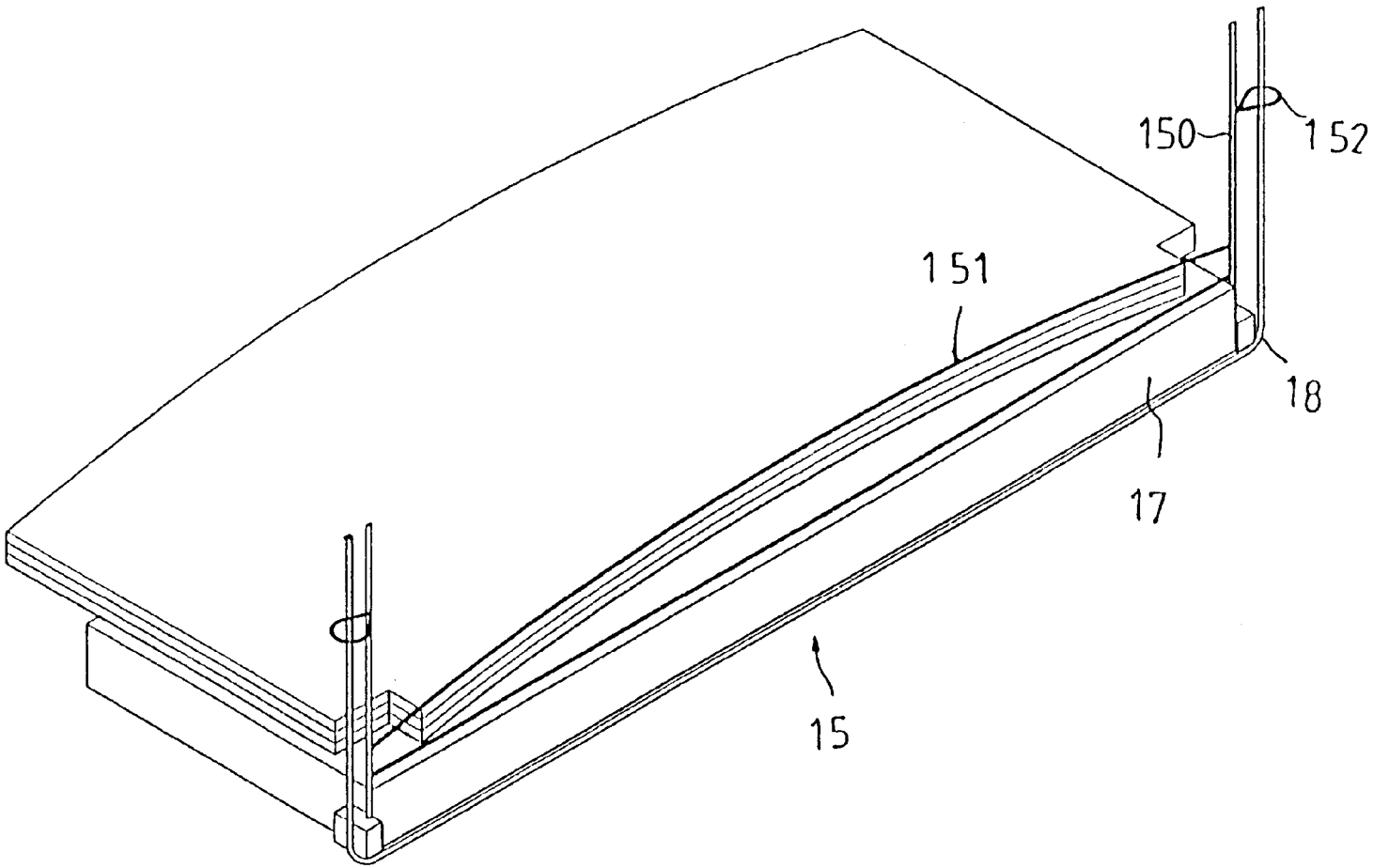
FIG. 5 is a schematic perspective view of a conventional venetian blind.
Figure 7:
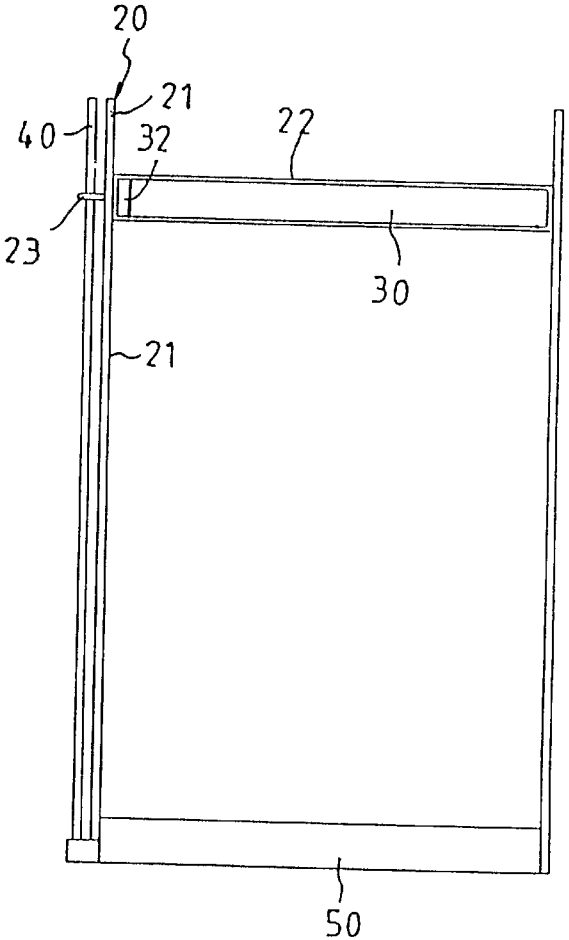
PRIOR ART FIG. 7
FIG. 7 is a sectional view of a conventional venetian blind.
Figure 6:
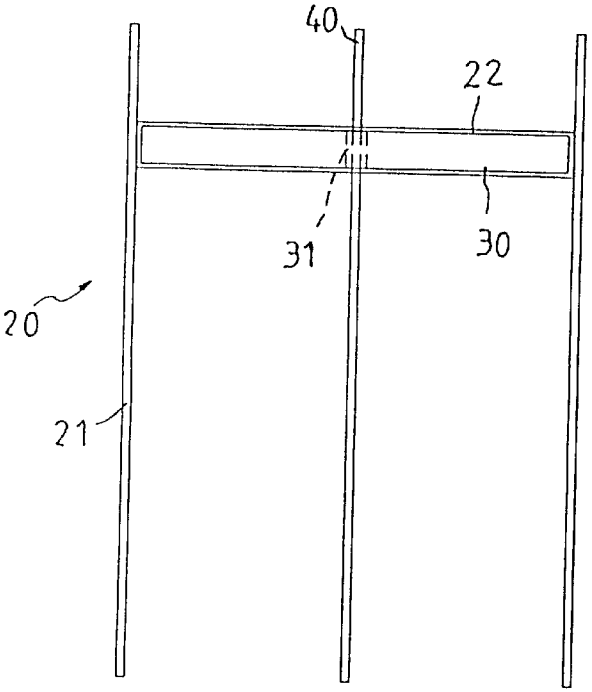
PRIOR ART FIG. 6
FIG. 6 is a schematic plan view of a conventional venetian blind.

3) Convenient replacement and storage of blind slats 16. The plurality of the restriction cords 151 (as shown in FIG. 2), allow the mounting of additional blind slats 16 within the restriction cords. If a blind slat 16 is damaged, another blind slat 16 can be directly withdrawn and replaced. No extra storage space for the prepared blind slats 16 is needed.

4) The longevity of the structure is improved. As the actuating of the structure is in order, even one restriction cord 151 is damaged (as a result of the damage of the blind slats 16), the other blind slats 16 are restricted by other restriction cords 151. Thus, the longevity of the structure is improved.

It will be apparent to those skilled in the art that the disclosed invention may be modified in numerous ways and may assume many embodiments other than the preferred form specifically set out it and described above. Accordingly, it is intended by the appended claims to cover all modifications of the invention which fall within the true spirit and scope of the invention.

I claim:

1. A slat actuating and positioning device for venetian blinds having a frame body mounted with a fixing seat, a slat control element being pivotally mounted at the center region of the top section of the two lateral walls of the fixing seat, the slat control element being driven by a control shaft and the slat control element being provided with a pulling cord, a main cord being provided at the two sides of the pulling cord and a restriction cord being provided in between the two main cord, the restriction cord passed through the slats and the bottom section of the main cord being mounted to a base seat, a suspension cord being provided at one lateral side of the main cord for actuating the entire structure of the venetian blind, wherein the suspension cord is connected at a fixing end at one side of the fixing seat and surrounds the slats and the base seat, and then passes to the frame body from the fixing seat to form a pulling end; a plurality of lugs are provided at intervals along the two main cord besides the pulling cord; a restriction cord is mounted in between the two main cord and the restriction cord is mounted in parallel in pairs, and the restriction cords are provided in a plurality sets; a plurality of slats are mounted within the restriction cord; and a recessed positioning slat is provided to the slats corresponding to the main cords, whereby the slat actuating and positioning device provides excellent stability in actuating the blind slats and improved longevity of the venetian blinds.

* * * * *

UNITED STATES PATENT AND TRADEMARK OFFICE

CERTIFICATE OF CORRECTION

PATENT NO. : 6,192,963 B1
DATED : February 27, 2001
INVENTOR(S) : Chen, Dong-Rong It is certified that error appears in the above-identified patent and that said Letters Patent is hereby corrected as shown below:

Column 4,
Lines 4, 12 and 14, “two main cord” should be -- two main cords --.
Line 17, “positioning slat” should be -- positioning slot --.

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,192,963 B1
DATED : February 27, 2001
INVENTOR(S) : Dong-Rong Chen It is certified that error appears in the above-identified patent and that said Letters Patent is hereby corrected as shown below:

Column 4,
Line 17, "cord" should read as -- cords --.

Signed and Sealed this

Seventeenth Day of February, 2004

JON W. DUDAS
*Acting Director of the United States Patent and Trademark Office*